US006971315B2

(12) United States Patent
Knappworst et al.

(10) Patent No.: US 6,971,315 B2
(45) Date of Patent: Dec. 6, 2005

(54) REDUCED-CONTAMINANT DEFORMABLE BULLET, PREFERABLY FOR SMALL ARMS

(75) Inventors: Jürgen Knappworst, Fürth (DE); Bernd Krause, Nürnberg (DE); Erich Muskat, Roth (DE); Friedrich Riess, Fürth (DE); Irene Schikora, Forchheim (DE)

(73) Assignee: RUAG Ammotec GmbH, Fuerth (DE)

( * ) Notice: Subject to any disclaimer, the term of this patent is extended or adjusted under 35 U.S.C. 154(b) by 213 days.

(21) Appl. No.: 10/221,105

(22) PCT Filed: Feb. 20, 2001

(86) PCT No.: PCT/EP01/01868

§ 371 (c)(1),
(2), (4) Date: Dec. 30, 2002

(87) PCT Pub. No.: WO01/67030

PCT Pub. Date: Sep. 13, 2001

(65) Prior Publication Data

US 2004/0025737 A1 Feb. 12, 2004

(30) Foreign Application Priority Data

Mar. 7, 2000 (DE) ..... 100 10 500

(51) Int. Cl.[7] ..... F42B 12/34

(52) U.S. Cl. ..... 102/510; 102/508

(58) Field of Search ..... 102/507, 508, 102/509, 510, 501, 511, 514, 516, 518, 439, 102/398, 517, 515

(56) References Cited

U.S. PATENT DOCUMENTS

| | | | | | |
|---|---|---|---|---|---|
| 623,707 | A | * | 4/1899 | Dittmar | 102/518 |
| 1,023,469 | A | * | 4/1912 | Haslett | 102/510 |
| 1,072,880 | A | * | 9/1913 | Tewes | 102/514 |
| 1,077,564 | A | * | 11/1913 | Starkweather | 102/507 |

(Continued)

FOREIGN PATENT DOCUMENTS

DE 199 30 473 A1 * 1/2001

(Continued)

*Primary Examiner*—Michael J. Carone
*Assistant Examiner*—James S. Bergin
(74) *Attorney, Agent, or Firm*—Antonelli, Terry, Stout and Kraus, LLP.

(57) ABSTRACT

Currently, 9 mm×19 mm caliber cartridges in the form of full-jacketed round-head bullets are used for small arms, especially for arms used by police. For safety reasons, efforts are being made to replace these bullets with a type of bullet that is prevented from passing straight through the target medium. Known deformable bullets from the prior art vary considerably in terms of the energy that they release in the target medium of density (1), especially in the human body. The invention therefore provides that the bullet (1) consists of a jacketless bullet body (2), that a cavity (5) extends centrally in relation to the longitudinal axis (15) of the bullet (1) in the tapered front part (6) of the bullet body (2), said cavity consisting of a cylindrical part (16) and at least one conical part (19) adjoining said cylindrical part; that a pusher (3) which forces the projectile open forms the bullet tip and that said pusher consists of a head (7) which seals the opening (4) of the cavity (5) and a shaft (8) which extends into the cavity (5).

31 Claims, 1 Drawing Sheet

U.S. PATENT DOCUMENTS

| | | | | | |
|---|---|---|---|---|---|
| 1,083,615 | A | * | 1/1914 | Johnson | 102/508 |
| 1,096,558 | A | * | 5/1914 | Newton | 102/508 |
| 1,134,797 | A | * | 4/1915 | Wood | 102/508 |
| 1,135,357 | A | * | 4/1915 | Clyne | 102/508 |
| 1,155,901 | A | * | 10/1915 | Duncan | 102/508 |
| 1,493,614 | A | * | 5/1924 | Dickerman | 102/510 |
| 1,556,160 | A | * | 10/1925 | Riggs | 102/510 |
| 2,234,165 | A | * | 3/1941 | Hatcher et al. | 102/526 |
| 2,292,047 | A | * | 8/1942 | Calhoun | 106/272 |
| 4,044,685 | A | * | 8/1977 | Avcin | 102/508 |
| 4,136,616 | A | * | 1/1979 | Schirneker | 102/510 |
| 4,175,492 | A | * | 11/1979 | Knappworst et al. | 102/503 |
| 4,245,557 | A | * | 1/1981 | Knappworst et al. | 102/508 |
| 4,655,140 | A | * | 4/1987 | Schirneker | 102/508 |
| 4,665,827 | A | * | 5/1987 | Ellis, II | 102/510 |
| 4,685,397 | A | * | 8/1987 | Schirneker | 102/510 |
| 4,776,279 | A | * | 10/1988 | Pejsa | 102/510 |
| 4,811,666 | A | * | 3/1989 | Lutfy | 102/501 |
| 5,291,833 | A | * | 3/1994 | Boual | 102/506 |
| 5,621,186 | A | * | 4/1997 | Carter | 102/507 |
| 5,760,329 | A | * | 6/1998 | Baum et al. | 102/439 |
| 6,209,459 | B1 | * | 4/2001 | Kaufman et al. | 102/439 |
| 6,526,893 | B2 | * | 3/2003 | May et al. | 102/508 |
| 6,655,295 | B2 | * | 12/2003 | Baumgartner et al. | 102/510 |
| 6,684,792 | B2 | * | 2/2004 | Denis | 102/516 |
| 2005/0034626 | A1 | * | 2/2005 | Sanborn | 102/510 |

FOREIGN PATENT DOCUMENTS

| | | | |
|---|---|---|---|
| WO | WO 01/67030 | A1 * | 9/2001 |

* cited by examiner

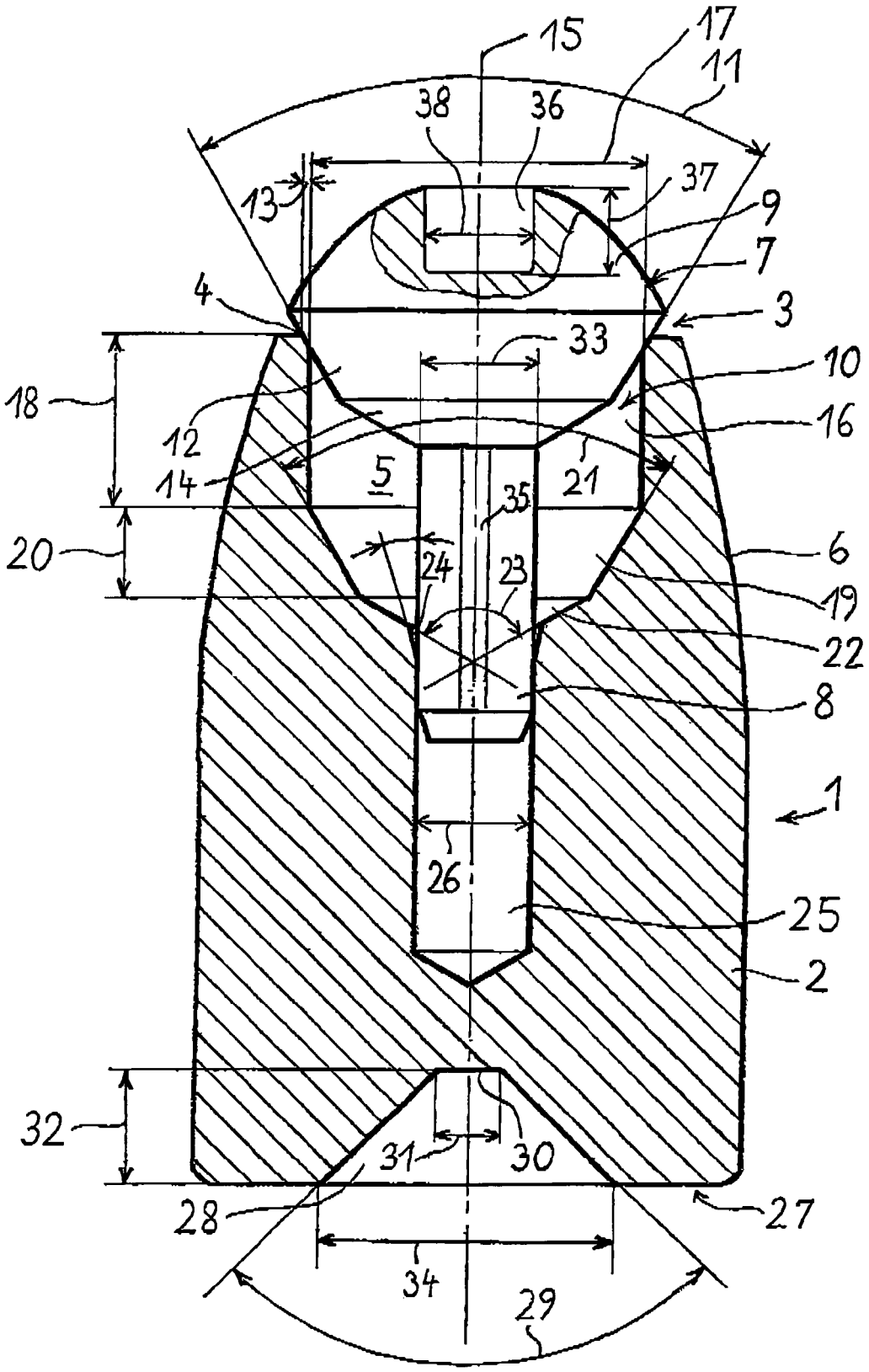
15
17
11
38
36
13
37
9
7
4
3
33
10
18
12
16
14
5
21
35
20
6
24
23
19
22
8
1
26
25
2
32
31
30
28
27
34
29

REDUCED-CONTAMINANT DEFORMABLE BULLET, PREFERABLY FOR SMALL ARMS

BACKGROUND OF THE INVENTION

The invention relates to a deformable bullet corresponding to the precharacterising clause of the first claim.

A deformable bullet is known from WO 01/02791 A2 which is designed especially for hunting purposes. In the front, tapering part of the bullet, there extends in the longitudinal axis thereof a hole, the cross section of which narrows in multiple stages starting from the tip. With this bullet it is intended to achieve defined deformation of the bullet as a function of the impact speed and adapted to the same in question.

At present, 9 mm×19 mm calibre cartridges in the form of full-jacketed round-head bullets are used for small arms, in particular arms provided for use by the police. For safety reasons, efforts are being made to replace these bullets with a type of bullet that is less prone to passing right through the target medium. Deformable bullets known from the prior art vary considerably in terms of the energy that they release in the target medium of density 1, in particular in the human body.

SUMMARY OF THE INVENTION

The object of the invention is to optimise the external and target ballistics of the bullet.

The object is achieved by means of the characterising features of the first claim. Advantageous developments of the invention are claimed in the subclaims.

The deformable bullet according to the invention consists of a jacketless metal body with a front part tapering towards the tip of the bullet and a rear, substantially cylindrical part. In the front, tapering part of the bullet, there extends in the direction of the longitudinal axis thereof a cavity which is composed of a cylindrical part and at least one conical part adjacent thereto together with a blind hole. The bullet tip takes the form of a "forcing-open plunger", which seals the opening in the bullet with regard to the cavity. The forcing-open plunger consists of a head sealing the opening in the bullet tip, which head is adjoined by a shank extending into the narrowest part of the cavity, the blind hole.

The bullet according to the invention allows defined deformation. The forcing-open plunger, which the opening of the cavity in the bullet with its head.

Defined deformation is achieved with the bullet according to the invention. The forcing-open plunger, which seals the opening of the cavity in the bullet with its head, is pressed into the cavity upon impact with the target body. The tapering part of the bullet body then mushrooms out from the opening of the cavity. The bullet is deformed into a mushroom-like shape. Deformation of the bullet body stops when the energy acting on the bullet body is no longer sufficient for deformation.

The deformation behaviour of the bullet body is influenced essentially by the following factors: the composition of the material and its properties and the geometry of the cavity and of the forcing-open plunger.

The composition of the bullet body material according to the invention is indicated below:

55%–100% copper (Cu),
0%–45% zinc (Zn) and
0%–4% lead (Pb).

By annealing with subsequent tempering, a tensile strength $R_m$ of from 250 N/mm$^2$ to 450 N/mm$^2$ and a yield point $R_{p0.2}$ of from 150 N/mm$^2$ to 250 N/mm$^2$ are achieved. The material composition together with the ratio, achieved by the heat treatment, of yield point to tensile strength effect deformation of the bullet upon impact with the target body without the feared fragmentation. The material composition together with the associated heat treatment result in optimum deformation behaviour, which prevents fragments from breaking off during mushrooming of the bullet body when such bullet penetrates into the target body. Mushrooming without fragmentation leads to defined energy output and thus to deceleration of the bullet in the target body. In this way, when this bullet is used, it is effectively prevented from passing right through the target body, except when used at extremely close range.

The surface of the bullet body is tinned. The thickness of the tin layer is approximately between 1 $\mu$m and 150 $\mu$m, preferably approximately between 2 $\mu$m and 5 $\mu$m. Tinning improves the sliding characteristics in the barrel and promotes optimum mushrooming of the bullet body.

The deformation behaviour of the bullet body is further determined by its optimum shape, in this case in particular by the shape of the cavity and of the forcing-open plunger sealing it. The forcing-open plunger sealing the opening to the cavity in the bullet body is composed of a head and of a shank adjacent thereto. As a rule, the shank is cylindrical and is guided in the blind hole bore in the bullet body. The shank has a diameter of approximately 2 mm and is so much larger with respect to the blind hole diameter that a press fit is obtained. So that, when the shank is driven into the blind hole, the air in the blind hole may escape, the shank is flattened on one side. The head of the forcing-open plunger is divided into two halves, of which the half facing the bullet body and sealing the opening is conical in shape. The second half, the tip or cap, projecting out of the bullet, is parabolic in shape when viewed in section. In this way, the bullet tip is particularly favourable with regard to flow dynamics. Moreover, the cap of the forcing-open plunger may comprise a bore which is central relative to the longitudinal axis of the bullet body. As a result of the bore, the force effect and deformation behaviour are reinforced in particular in soft targets. This bore may be cylindrical, conical, cone-shaped or rounded. It has a depth of approximately 0.5 mm to 4 mm, preferably of approximately 1 mm to 2 mm, and a diameter at the opening of approximately 0.5 mm to 4 mm, preferably of approximately 2 mm.

The opening in the tip of the bullet body has a cylindrical shape with a diameter of approximately between 4 mm and 6 mm, preferably approximately between 5 mm and 5.5 mm. The wall thickness in the tip of the bullet body is thereby reduced far enough for optimum mushrooming of the bullet body to be achieved.

A further factor influencing optimum mushrooming of the bullet body is the depth, i.e. the length, of the cavity and its shape. The cylindrical part of the cavity has a length of approximately 2 mm to 7 mm, preferably approximately 3 mm to 5 mm. Adjoining this is a conical part of approximately 1 mm to 2 mm, preferably approximately 1.5 mm. This conical part is adapted in length to the previous cylindrical part. The cone angle is approximately between 50° and 70°, preferably approximately 60°. A substantially shorter conical part with a cone angle of approximately double the size may adjoin this conical part before the opening undergoes transition into the blind hole for guidance of the shank of the forcing-open plunger.

The cylindrical bore is longer by at least a few tenths of a millimeter than the shank of the forcing-open plunger and has a length of approximately 2 mm to 7 mm, preferably approximately 1 mm to 3 mm, and is adapted to the length of the shank of the forcing-open plunger.

The forcing-open plunger consists of a lead-free material. Plastics such as polyethylene (PE) may be used, for example, or metals such as tin, zinc, aluminium or copper. Biodegradable plastics are also advantageous. Moreover, the small lead content in the bullet body contributes to the greatest possible extent to the prevention of toxic contamination of the tissue. The bullet may thus be designated as reduced-contaminant.

If the forcing-open plunger consists of plastics, a metal powder which causes particularly good X-ray scattering, such as for example iron or tungsten or the material barium sulfate ($BaSO_4$) is included in the head of the forcing-open plunger. This makes it possible to find the forcing-open plunger in the tissue of the target body, especially when, due to an unfortunate circumstance, the forcing-open plunger has become separated from the remaining bullet core.

In addition, the deformation behaviour of the impacting bullet is influenced by the shape of the head of the forcing-open plunger. The conical part of the head of the forcing-open plunger is clamped into the opening to the cavity of the bullet body, which opening is shaped like a chamfer. The opening is formed over only a few tenths of a millimeter of length in this conical surface, which has the same cone angle as the cone angle of the head of the forcing-open plunger.

When the bullet hits the target body, the head of the forcing-open plunger is forced by the impact through the opening in the bullet body firstly into the cylindrical part of the cavity. In the process, the rear conical part of the head pushes the material of the thin wall of the bullet body outwards, such that it is torn open and rolled up backwards opposite to the direction of movement of the bullet body, thereby lending the bullet body a mushroom-like shape. When the conical part of the bullet body impinges on the tapering conical part of the cavity, penetration of the head of the forcing-open plunger is stopped. The cone angle of the conical part of the head of the forcing-open plunger is smaller by a few degrees than the cone angle of the conical part of the cavity of the bullet body, such that it penetrates fully into this conical part of the cavity and is then stopped there. The geometries of the bullet body and of the forcing-open plunger are conformed to one another, in particular with regard to the geometry of the cavity, in such a way that, when the bullet body penetrates into the target body, the bullet body does not fragment during mushrooming.

At the rear of the bullet, a conical recess is formed centrally relative to the longitudinal axis of the bullet. The depth amounts to approximately 0.5 mm to 3 mm, preferably approximately 1 mm to 2 mm. The cone angle is approximately between 70° and 120°, preferably approximately 90°. The diameter depends on the cone angle and depth. The recess may taper conically to a point, but a circular base surface may also be provided, such that the diameter of this base surface may vary by approximately 0 mm to 2 mm, the diameter preferably being approximately 1 mm. The recess is likewise conformed to the geometry of the bullet body. It promotes the flow behaviour of the propellant gases and thus stabilises the movement of the bullet.

BRIEF DESCRIPTION OF THE DRAWING

The sole drawing figure shows a cross section of the bullet of the present invention according to one embodiment.

DETAILED DESCRIPTION OF THE INVENTION

The invention will be explained in more detail with reference to an exemplifying embodiment. The present exemplifying embodiment is illustrated by a cross section, on a greatly enlarged scale, through a jacketless deformable bullet (1) according to the invention for a 9 mm×19 mm cartridge for use in small arms, in particular police weapons. The deformable bullet (1) is composed of a bullet body (2), which, as is not shown here, is coated with a thin layer of tin of approximately 2 $\mu$m, and a forcing-open plunger (3), which seals an opening (4) of a cavity (5) in the tapering part (6) of the bullet body (2).

The forcing-open plunger (3) consists of a head (7) and a shank (8), which has a substantially smaller diameter than the head (7). The head (7) is composed of a cap (9) forming the tip of the bullet (1) and a conical part (10), stepped twice in this case, sealing the opening (4) of the cavity (5). For aerodynamic reasons, the cap (9) has a parabolic sectional profile. The cone angle (11) of the first conical part (12) of the head (7) amounts in the present exemplifying embodiment to 56°. The angle is the same as that of the edge (13) of the opening (4) into which the conical part (12) of the head (7) of the forcing-open plunger (3) is forced, which edge (13) is comparable to a chamfer. The first conical part (12) of the head (7) is adjoined by a further conical part (14) with a cone angle of approximately double the size, which undergoes transition into the cylindrical shank (8). The shank (8) has a length of approximately 5 mm altogether.

The cavity (5) in the bullet body (2) is arranged symmetrically to the longitudinal axis (15) of the bullet body (2). In the present exemplifying embodiment, the cylindrical part (16) of the cavity (5) has a diameter (17) of 5.5 mm. In this way, the wall thickness of the tapering part (6) of the bullet body (2) is reduced to below 1 mm.

This low wall thickness promotes considerably the deformation behaviour of the bullet body. The length (18) of the cylindrical part (16) of the cavity (5) amounts in the present exemplifying embodiment to 3 mm. Adjoining this is a first conical part (19) of 1.5 mm in length (20). The cone angle (21) amounts to 60° and in the present exemplifying embodiment is thus 4° smaller than the cone angle (11) of the first conical part (10) of the head (7) of the forcing-open plunger (3). This first conical part (19) stops further penetration of the forcing-open plunger (3) into the bullet body (2) upon impact with a target body.

The first conical part (19) is adjoined by a second conical part (22) of a few tenths of a millimeter in length. Its cone angle (23) is, at 120°, in this case twice as big as the cone angle (21) of the first conical part (19). The second conical part (22) leads into the blind hole (25) with a chamfer (24), for easier introduction of the shank (8). The blind hole (25) serves for guidance of the shank (8) and is only a few tenths of a millimeter longer than the latter. The diameter (26) of the blind hole (25) amounts to 1.9 mm and is approximately 0.1 mm smaller than the diameter (33) of the shank (8), such that the latter is held in the blind hole (25) by a press fit. (35) denotes a flattened portion of the shank (8), which allows air to escape when the shank is forced into the blind hole (25).

When the deformable bullet (1) impacts on the target body, the head (7) of the forcing-open plunger (3) is first of all forced into the cavity (5). In the process, the first conical part (12) of the head (7) pushes the material of the wall of the cylindrical part (16) of the cavity (5) outwards towards the bullet end (27) opposite to the penetration direction, such that the cylindrical part (16) of the cavity (5) mushrooms without tearing off and thereby without fragmentation, upon penetration into the target body. The forcing-open plunger (3) is guided by its shank (8) in the blind hole (25) during the backwards motion. In this way, uniform mushrooming of the bullet body (2) occurs. Movement of the forcing-open plunger (3) is stopped when the first conical part (12) of the forcing-open plunger (3) hits the wall of the first conical part (19) of the cavity (5).

At the bullet rear (27) there is located a recess (28), lying centrally relative to the longitudinal axis (15) of the bullet body (2). The recess is conical, with the cone angle (29) amounting to 90°. At the base of the recess there is located a circular surface (30) with a diameter (31) of 1 mm. The depth (32) of the recess amounts in the present exemplifying embodiment to approximately 2 mm, its diameter (34) being approximately 5 mm. This recess serves, in particular upon firing, to influence escape of the propellant gases and to stabilise the movement of the deformable bullet (1).

Moreover, the cap (9) of the forcing-open plunger (3) comprises a cylindrical bore (36) lying centrally relative to the longitudinal axis (15) of the bullet body (2). In the present exemplifying embodiment, it has a depth (37) of 1.5 mm and a diameter of 2 mm. The force action and the deformation behaviour are reinforced by the bore, in particular in soft targets.

What is claimed is:

1. A deformable bullet having a front part tapering towards the tip of the bullet and a rear, substantially cylindrical part, the bullet comprising a jacketless bullet body, in the tapering, front part of which there extends a cavity centrally relative to the longitudinal axis of the bullet, characterised in that the cavity comprises an opening at the front part of the bullet having a chamfered edge, a cylindrical part extending rearwardly therefrom, and at least one conical part adjacent thereto and extending rearwardly therefrom, in that a forcing-open plunger forms the bullet tip, in that the forcing-open plunger comprises a head sealing the opening of the cavity, the head having a rearwardly facing conical part, and a shank extending into the cavity and in that the head is supported with its conical part on the chamfered edge of the opening to the cavity.

2. A deformable bullet according to claim 1, characterised in that the part of the head of the forcing-open plunger sealing the opening of the cavity is conical in shape with a cone angle of from approximately 40° to 75°.

3. A deformable bullet according to claim 2, characterised in that the angle of the conical part of the cavity is approximately between 50° and 70°.

4. A deformable bullet according to claim 3, characterised in that the angle of the conical part of the cavity is a few degrees larger than the cone angle of the conical part of the head of the forcing-open plunger.

5. A deformable bullet according to claim 2, characterised in that the angle of the conical part of the cavity is approximately 60°.

6. A deformable bullet according to claim 1, characterised in that the cylindrical part of the cavity exhibits a length of from approximately 2 mm to 7 mm, and in that its diameter is approximately between 4 mm and 6 mm.

7. A deformable bullet according to claim 1, characterised in that the conical part of the cavity is approximately 1 mm to 2 mm long.

8. A deformable bullet according to claim 1, characterised in that the shank of the forcing-open plunger is held in a blind hole by a press fit.

9. A deformable bullet according to claim 8, characterised in that the shank of the forcing-open plunger is approximately 2 mm to 7 mm long.

10. A deformable bullet according to claim 9, characterised in that the blind hole is adapted to the length of the shank and is a few tenths of a millimeter longer.

11. A deformable bullet according to claim 8, characterised in that the shank of the forcing-open plunger is approximately 1 mm to 3 mm long.

12. A deformable bullet according to claim 1, characterised in that the bullet rear comprises, centrally relative to the longitudinal axis, a conical recess with a cone angle of approximately between 70° and 120°.

13. A deformable bullet according to claim 12, characterised in that the depth of the recess amounts to approximately 0.5 mm to 3 mm.

14. A deformable bullet according to one of claims 12 or 13, characterised in that the recess is closed off at the base by a circular surface with a diameter of up to approximately 2 mm.

15. A deformable bullet according to claim 12, characterised in that the depth of the recess amounts to approximately 1 mm to 2 mm.

16. A deformable bullet according to one of claims 12 or 13, characterised in that the recess is closed off at the base by a circular surface with a diameter of approximately 1 mm.

17. A deformable bullet according to claim 1, characterised in that the material composition of the bullet body comprises 55% to 100% copper, 0% to 45% zinc and 0% to 4% lead.

18. A deformable bullet according to claim 1, characterised in that the tensile strength Rm of the material of the bullet ranges from 250 N/mm$^2$ to 450 N/mm$^2$ and the yield point $R_{p0.2}$ thereof from 150 N/mm$^2$ to 250 N/mm$^2$.

19. A deformable bullet according to claim 1, characterised in that the forcing-open plunger consists of a lead-free material.

20. A deformable bullet according to claim 19, characterised in that the materials of the forcing-open plunger are plastics, or metals.

21. A deformable bullet according to claim 20, characterised in that the forcing-open plunger is made of a material selected from the group consisting of polyethylene, tin, zinc, aluminum and copper.

22. A deformable bullet according to claim 19, characterised in that metal powder is added to a head of the forcing-open plunger of non-metals.

23. A deformable bullet according to claim 22, characterised in that the metal powder is barium sulfate ($BaSO_4$).

24. A deformable bullet according to claim 1, characterised in that the forcing-open plunger further comprises a cap having a forwardly opening cylindrical or conical or cone-shaped or rounded bore central relative to the longitudinal axis of the bullet body, said bore having a diameter of from approximately 0.5 mm to 4 mm, and a depth of from approximately 0.5 mm to 4 mm.

25. A deformable bullet according to claim 1, characterised in that the bullet body is tinned and in that the tin layer exhibits a thickness of from approximately 1 $\mu$m to 150 $\mu$m.

26. A deformable bullet according to claim 1, characterised in that the part of the head of the forcing-open plunger sealing the opening of the cavity is conical in shape with a cone angle of from approximately 50° to 65°.

27. A deformable bullet according to claim 1, characterised in that the cylindrical part of the cavity exhibits a length of from approximately 3 mm to 5 mm, and in that its diameter is approximately between 5 mm and 5.5 mm.

28. A deformable bullet according to claim 1, characterised in that the conical part of the cavity is approximately 1.5 mm long.

29. A deformable bullet according to claim 1, characterised in that the bullet rear comprises, centrally relative to the longitudinal axis, a conical recess with a cone angle of approximately 90°.

30. A deformable bullet according to claim 1, characterised in that the forcing-open plunger comprises in its cap a cylindrical or conical or cone-shaped or rounded bore central relative to the longitudinal axis of the bullet body, said bore having a diameter of approximately 2 mm, and a depth of from approximately 1 mm to 2 mm.

31. A deformable bullet according to claim 1, characterised in that the bullet body is tinned and in that the tin layer exhibits a thickness of from approximately 2 $\mu$m to 5 $\mu$m.

* * * * *